US007862389B2

(12) United States Patent
Pizzi

(10) Patent No.: US 7,862,389 B2
(45) Date of Patent: Jan. 4, 2011

(54) TERMINAL BLOCK WITH U-SHAPED CONDUCTING PART FOR CONNECTING ELECTRIC WIRES

(75) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 11/829,331

(22) Filed: Jul. 27, 2007

(65) Prior Publication Data

US 2008/0070450 A1 Mar. 20, 2008

(30) Foreign Application Priority Data

Jul. 28, 2006 (IT) ..... MI2006A1496

(51) Int. Cl.
*H01R 9/22* (2006.01)

(52) U.S. Cl. ..... 439/715; 439/709; 439/789; 439/791

(58) Field of Classification Search ..... 439/715, 439/716, 709, 723, 789, 791, 796, 532, 94
See application file for complete search history.

(56) References Cited

U.S. PATENT DOCUMENTS

| | | | | |
|---|---|---|---|---|
| 945,017 | A | 1/1910 | Cole | |
| 2,045,847 | A | 6/1936 | Fotsch | |
| 2,082,947 | A | 6/1937 | Fotsch | |
| 2,900,618 | A | 8/1959 | Geier | |
| 3,159,730 | A | 12/1964 | Staffel | |
| 3,609,642 | A | 9/1971 | Norden | |
| 3,665,376 | A * | 5/1972 | Paris et al. | 439/722 |
| 3,751,579 | A | 8/1973 | Nojiri | |
| 3,775,733 | A * | 11/1973 | Ege | 439/724 |
| 3,840,781 | A | 10/1974 | Brown | |
| 4,070,086 | A | 1/1978 | Trafford | |
| 4,130,331 | A | 12/1978 | Neff et al. | |
| 4,171,861 | A | 10/1979 | Hohorst | 339/198 G |
| 4,203,200 | A | 5/1980 | Wiebe | |
| 4,224,592 | A | 9/1980 | Urani et al. | |
| 4,241,975 | A | 12/1980 | Cooper, Jr. | |
| 4,330,164 | A | 5/1982 | Pittman et al. | |
| 4,340,270 | A * | 7/1982 | Wilmes et al. | 439/397 |
| 4,350,407 | A | 9/1982 | Tong | |
| 4,365,396 | A | 12/1982 | Baba et al. | |
| 4,391,485 | A | 7/1983 | Urani | |
| 4,444,455 | A | 4/1984 | Wiancko et al. | |
| 4,559,504 | A | 12/1985 | Krec | |
| 4,693,533 | A | 9/1987 | Szczesny et al. | |

(Continued)

FOREIGN PATENT DOCUMENTS

DE 1842868 U 12/1961

(Continued)

OTHER PUBLICATIONS

European Search Report from EP08075059, dated, Aug. 24, 2009.

*Primary Examiner*—Edwin A. Leon
*Assistant Examiner*—Vanessa Girardi
(74) *Attorney, Agent, or Firm*—Mintz Levin Cohn Ferris Glovsky and Popeo, P.C.

(57) ABSTRACT

Terminal block for connecting electric wires comprising an insulating body and a conducting part housed inside it and associated with means for retaining the free end of the electric wire, said conducting part having a U-shaped form.

31 Claims, 4 Drawing Sheets

U.S. PATENT DOCUMENTS

| | | | | | |
|---|---|---|---|---|---|
| 4,889,504 | A | | 12/1989 | Barbier et al. | |
| 4,921,450 | A | | 5/1990 | Herbert | |
| 4,940,431 | A | | 7/1990 | Hennemann | |
| 5,002,505 | A | | 3/1991 | Jones et al. | |
| 5,030,131 | A | | 7/1991 | Boehm | |
| 5,090,922 | A | * | 2/1992 | Rymer et al. | 439/716 |
| 5,243,139 | A | | 9/1993 | Law | |
| 5,276,280 | A | | 1/1994 | Ball | |
| 5,328,392 | A | | 7/1994 | Lin et al. | |
| 5,454,730 | A | | 10/1995 | Tozuka | |
| 5,553,787 | A | | 9/1996 | Guginsky | |
| 5,564,941 | A | | 10/1996 | Norden | |
| 5,766,044 | A | | 6/1998 | Norden | |
| 5,853,304 | A | * | 12/1998 | Landreau et al. | 439/721 |
| 5,860,837 | A | * | 1/1999 | Bock et al. | 439/828 |
| 5,905,230 | A | | 5/1999 | Marik | |
| 5,915,998 | A | | 6/1999 | Stidham et al. | |
| 6,004,167 | A | * | 12/1999 | Hirakawa | 439/811 |
| 6,157,287 | A | | 12/2000 | Douglass et al. | |
| 6,475,038 | B1 | | 11/2002 | Franck | |
| 6,786,779 | B2 | | 9/2004 | Feldmeier et al. | |
| 7,101,231 | B2 | * | 9/2006 | Prokup et al. | 439/709 |
| 7,385,518 | B2 | | 6/2008 | Torrez et al. | |
| 7,413,486 | B2 | | 8/2008 | Pizzi | |
| 7,438,606 | B2 | | 10/2008 | Pizzi | |
| 7,500,889 | B2 | | 3/2009 | Pizzi | |
| 2002/0067279 | A1 | | 6/2002 | Torrez et al. | |
| 2005/0042912 | A1 | | 2/2005 | Drewes et al. | 439/441 |
| 2005/0221665 | A1 | * | 10/2005 | Otto et al. | 439/532 |
| 2006/0128232 | A1 | * | 6/2006 | Kim | 439/813 |
| 2006/0148302 | A1 | | 7/2006 | Patel et al. | |
| 2006/0189222 | A1 | | 8/2006 | Bogiel et al. | |
| 2006/0228950 | A1 | * | 10/2006 | Jamaleddin et al. | 439/709 |
| 2008/0248698 | A1 | * | 10/2008 | Pizzi | 439/709 |
| 2009/0017702 | A1 | * | 1/2009 | Pizzi | 439/812 |

FOREIGN PATENT DOCUMENTS

| | | | | |
|---|---|---|---|---|
| DE | 33 39 365 | A1 | | 5/1985 |
| DE | 3339365 | A1 | | 5/1985 |
| DE | 36 21 071 | A1 | | 1/1987 |
| DE | 3621071 | A1 | | 1/1987 |
| DE | 3629796 | C1 | | 12/1987 |
| DE | 3805158 | A1 | | 8/1989 |
| DE | 3629796 | | * | 6/1993 |
| DE | 4223540 | A1 | | 1/1994 |
| DE | 4231244 | A1 | | 3/1994 |
| DE | 4409612 | | * | 9/1994 |
| DE | 4409612 | A1 | | 9/1994 |
| DE | 195 30 947 | A1 | | 1/1997 |
| DE | 19530947 | A1 | | 1/1997 |
| DE | 19542628 | C1 | | 2/1997 |
| DE | 197 29 327 | C1 | | 10/1998 |
| DE | 19729327 | C1 | | 10/1998 |
| DE | 29821558 | U1 | | 3/1999 |
| DE | 29921080 | | | 4/2001 |
| DE | 299 21 080 | U1 | | 5/2001 |
| DE | 100 10 719 | C1 | | 8/2001 |
| DE | 10010719 | C1 | | 8/2001 |
| DE | 10324144 | A1 | | 2/2005 |
| DE | 102004018553 | A1 | | 11/2005 |
| DE | 202005005369 | U1 | | 3/2006 |
| EP | 0382999 | | | 8/1990 |
| EP | 0678934 | A1 | | 10/1995 |
| EP | 0893859 | A2 | | 1/1999 |
| EP | 1137034 | A1 | | 9/2001 |
| EP | 1137035 | A1 | | 9/2001 |
| EP | 1381068 | A1 | | 1/2004 |
| EP | 1531522 | A1 | | 5/2005 |
| EP | 1536519 | A1 | | 6/2005 |
| EP | 1630903 | A1 | | 3/2006 |
| EP | 1798821 | A2 | | 6/2007 |
| EP | 1860738 | A1 | | 11/2007 |
| EP | 1887658 | A2 | | 2/2008 |
| FR | 2259462 | A1 | | 8/1975 |
| FR | 2529024 | A1 | | 12/1983 |
| FR | 2637740 | A1 | | 4/1990 |
| FR | 2766628 | A1 | | 1/1999 |
| GB | 2342508 | A | | 4/2000 |

* cited by examiner

TERMINAL BLOCK WITH U-SHAPED CONDUCTING PART FOR CONNECTING ELECTRIC WIRES

BACKGROUND

1. Field of the Invention

The present invention relates to a terminal block for connecting electric wires, comprising an insulating body and a U-shaped conducting part.

2. Description of the Prior Art

It is known in the technical sector relating to the manufacture of switchboards for wires of electrical installations to use terminal blocks which are designed to be mounted on associated supports and to provide frontal access to the means—normally of the screw type—for retaining the electric connecting wires which form the electric circuit.

It is also known that, in order to be able to limit the overall dimensions of the terminal block, it is necessary to produce the internal conducting part, which connects the input to the output of the terminal block, from a material with a high electric conductivity, such as, for example, copper or the like, since the small dimensions of the assembly would not be able to support the required electric load; on the other hand, owing to the high cost of said conductive materials, the dimensions of the terminal block and therefore its rated electric load must be limited in order to avoid excessively high production and distribution costs.

SUMMARY

The technical problem which is posed, therefore, is to provide a terminal block, in particular of the type for wired circuit switchboards, which has small overall dimensions, but at the same time is able to withstand a high electric load.

In connection with this problem it is also desired that this terminal block should be easy and inexpensive to produce and assemble and be able to be used equally well with the various types of means for fixing the electric wire to be connected and should be able to be operated easily by any user using normal standardized tools.

These results are achieved according to the present invention by a terminal block for connecting electric wires comprising an insulating body and a conducting part housed inside it and associated with means for retaining the free end of the electric wire, said conducting part having a U shape.

BRIEF DESCRIPTION OF THE FIGURES

Further details may be obtained from the following description of a non-limiting example of embodiment of the subject of the present invention provided with reference to the accompanying drawings, in which.

DETAILED DESCRIPTION OF PREFERRED EMBODIMENTS

Figure 1:
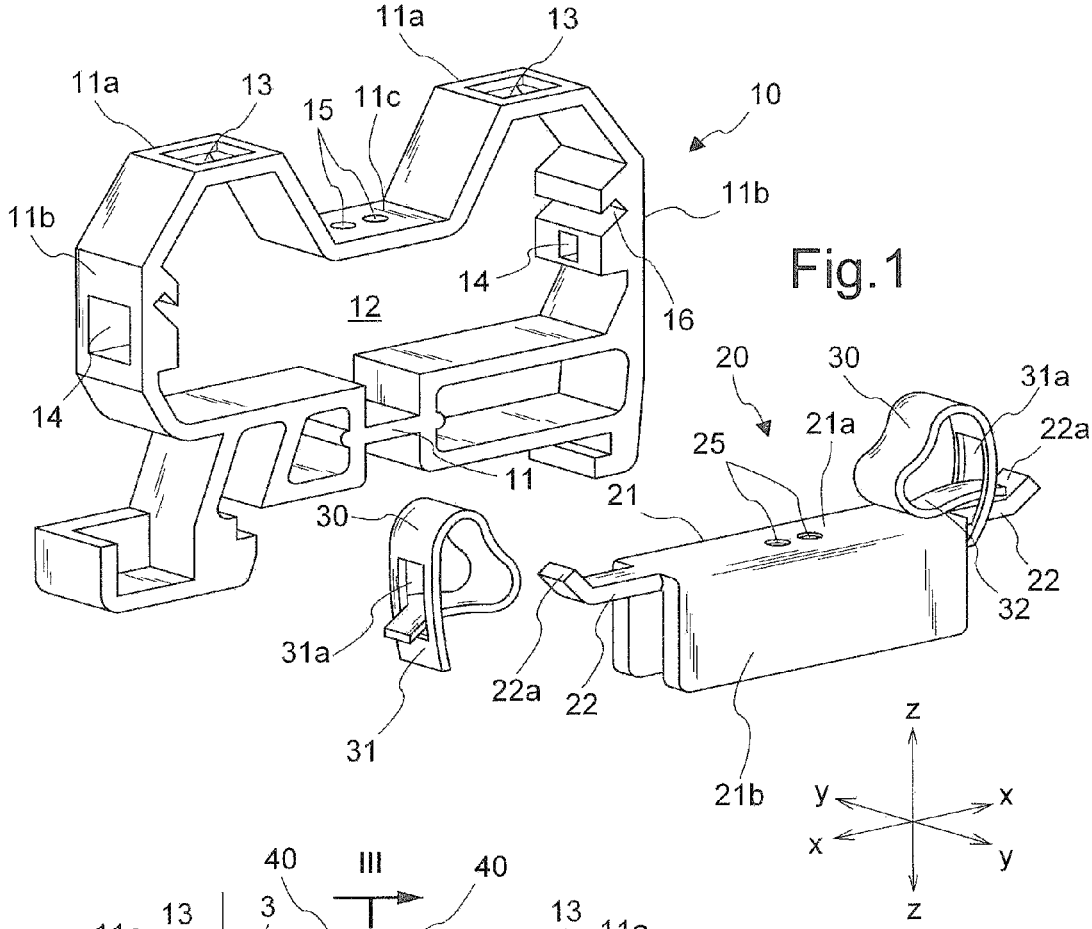
FIG. 1 shows an exploded perspective view of a first embodiment of the terminal block according to the present invention.

As shown in FIG. 1 and assuming solely for the sake of convenience of the description and without a limiting sense a set of three reference axes, i.e. longitudinal direction X-X, transverse direction Y-Y and vertical direction Z-Z, respectively, an embodiment of a terminal block according to the present invention comprises an insulating body 10 forming the container for the conducting part 20 associated with the clamp or retaining means 30 for retaining the free end la of the electric wire 1.

In greater detail said insulating body 10 has a closed annular structure 11 defining a seat 12 open in the transverse direction Y-Y; said structure 11 is formed in the manner of two partial octagons arranged facing each other relative to the vertical axis Z-Z and identifying at least one respective front end side 11*a* and at least one respective flank 11*b* in which corresponding apertures 13 and 14 are formed in the vertical direction and horizontal direction, respectively, said apertures allowing said seat 12 to communicate with the exterior.

The seat 12 communicates with the exterior also by means holes 15 with a vertical axis Z-Z formed in a substantially longitudinal end wall 11*c* of the structure 11.

The conducting part 20, which during use connects the input to the output of the terminal block, is formed by means of a U-shaped body 21, the base 21*a* of which extends in the longitudinal direction outwards at both the opposite ends so as to form two flanges 22 with their tip 22*a* inclined upwards; said flanges are designed to engage with a corresponding seat 16 provided in the side 11*b* of the structure 11 so that the conducting part 20 is stably fixed to the insulating body 10.

The base 21*a* also has, extending from it, the parallel sides 21*b* of the U, said sides extending in the vertical direction Z-Z along a suitable section determined according to the electric load envisaged for the terminal block.

The base 21*a* of the U is also provided with at least two holes 25 which, during use, are arranged coaxially with the holes 15 of the structure as will become clear below.

The conducting part 20 is completed by the claim or retaining means 30 for retaining the end 1*a* of the electric wire 1, which are constrained to the said longitudinal flanges 22; in the example according to FIG. 1, the retaining means 30 includes a spring having a closed annular shape and with a side 31 having an opening 31*a* passed through by the end of the side 32 resting against the connector 20.

Figure 2:
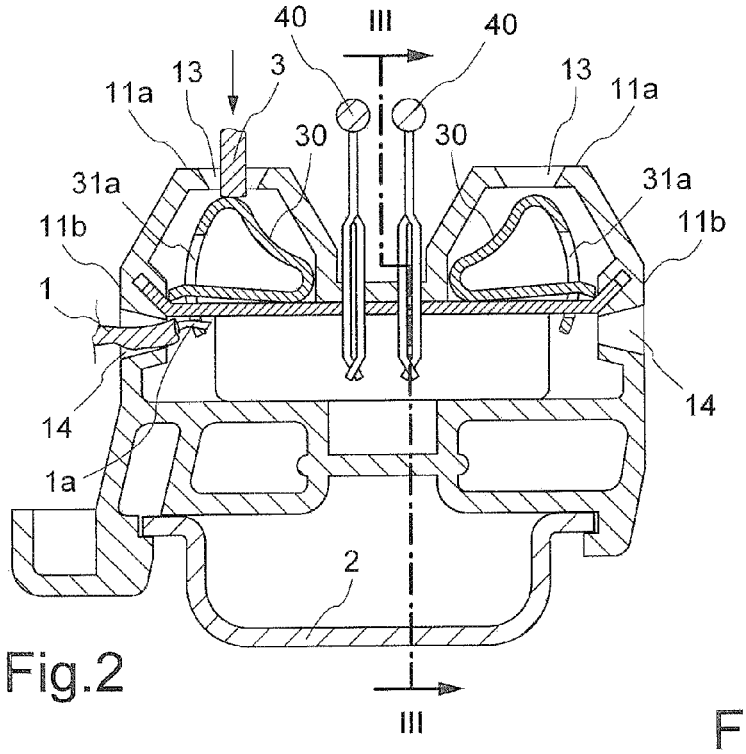
FIG. 2 shows a schematic cross-section, along a vertical longitudinal plane, of the terminal block according to FIG. 1.
Figure 3:
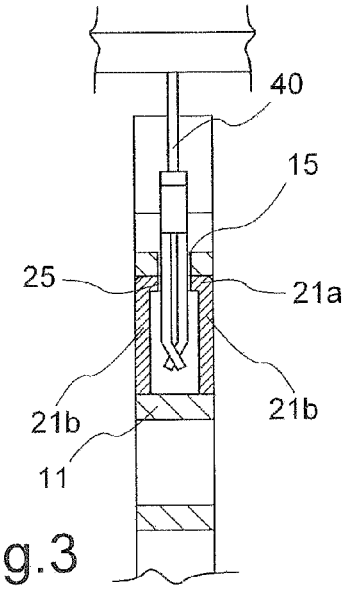
FIG. 3 shows a schematic cross-section along the plane indicated by III-III in FIG. 2.

As shown in FIGS. 2 and 3, during use:

- the conducting part 20 is housed inside the seat 12 of the insulating body with flanges 22 inserted inside the corresponding seats 16 in the sides 11*b* of the structure;
- the cusp of the spring of retaining means 30 is aligned with the vertical axis of the end hole 13 which allows insertion of the tool 3 in order to compress the spring to the side 31 and move the opening 31*a* underneath the contact flange 32;
- this allows insertion, through the side hole 14, of the wire 1 for fixing thereof, which is performed by means of the elastic reaction of the spring and return movement of the side 31 once the tool 3 is extracted;

during assembly the holes 15 and 25 are situated coaxially aligned so as to allow the insertion of any jumpers 40 for electrical connection with other terminal blocks (FIG. 3) as required by the specific electric diagram.

Figure 4:
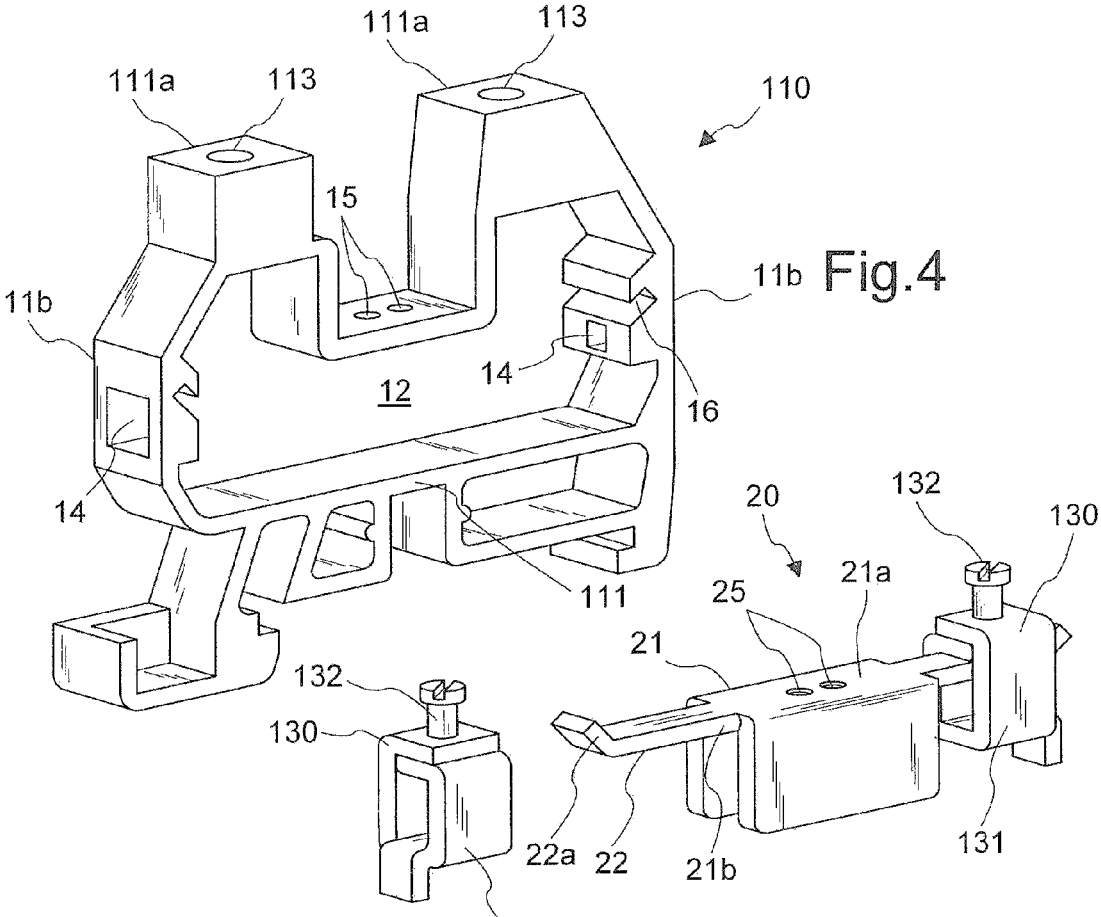
FIG. 4 shows an exploded perspective view of a second embodiment of the terminal block according to the present invention.
Figure 5:
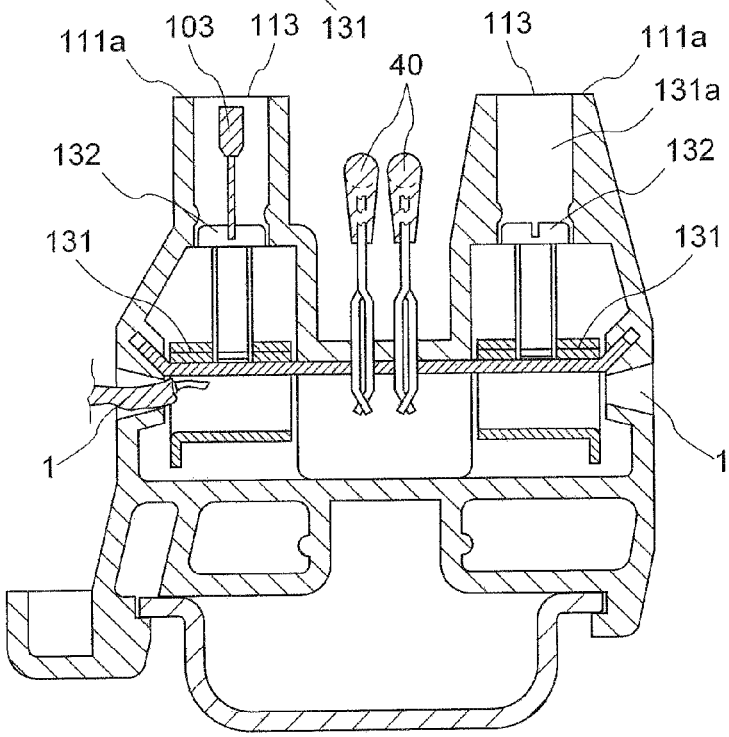
FIG. 5 shows a schematic cross-section, along a vertical longitudinal plane, of the terminal block according to FIG. 4.

FIGS. 4 and 5 show a second embodiment of the terminal block according to the present invention, which encludes, in this case, retaining means 130 for retaining the electric wire 1 of the type comprising a clamp 131 and screw 132; correspondingly the end side 111*a* of the structure has a suitable thickness in the vertical direction Z-Z so as to form the seat 131*a* for the tightening screw 132 which can be operated by means of a screwdriver 103 coaxially inserted inside the hole 113 for access to the head of the screw.

Since the remaining parts of the assembly correspond to those of the configuration shown in FIG. 1, said parts are only illustrated, but not described, the person skilled in the art being able to understand how they function.

Figure 6:
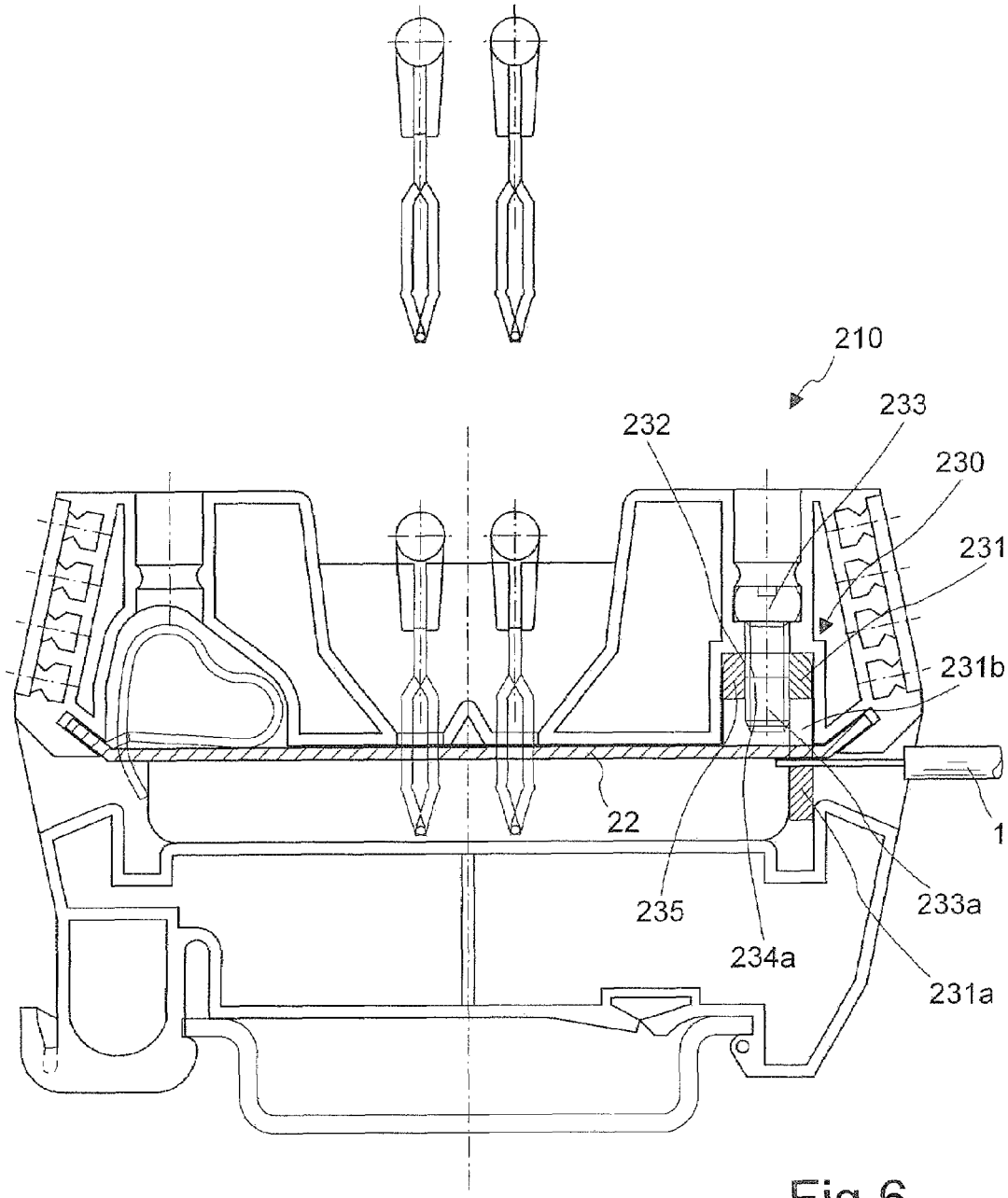
FIG. 6 shows a schematic cross-section, along a vertical longitudinal plane, of a third embodiment of the terminal block according to the invention.

FIG. 6 shows a third embodiment wherein the terminal block 210 includes retaining means 230 for retaining the electric wire 1 in the form of a screw clamp where the conducting body 231 able to grip the electric wire against the flanges 22 is in the form of an "overturned L". In greater detail, this body 231 in the form of an "overturned L" has a vertical side 231*a* with a length greater than the longitudinal horizontal side 232, arranged perpendicularly with respect to the longitudinal direction (X-X) of insertion of the wire 1,1*a*.

In addition to this, said vertical side 231 has an opening 231*b* able to allow entry of the end 1*a* of the wire 1 in the longitudinal direction (X-X); the longitudinal horizontal side 232 in turn has means 234,234*a* for engagement with the operating devices 233.

In the example shown, said engaging means comprise a hole 234 with a vertical axis (Z-Z) having a female thread 234*a* and the operating means comprise a screw 233 with a shank 233*a* having a thread corresponding to the female thread 234*a* of the clamping part.

The said longitudinal horizontal side 232 has a free end 235 which is folded downwards in a substantially vertical direction (Z-Z); said folded free end 235 is able to interfere with the operating screw 233 so as to ensure locking thereof once tightened.

Figure 7:
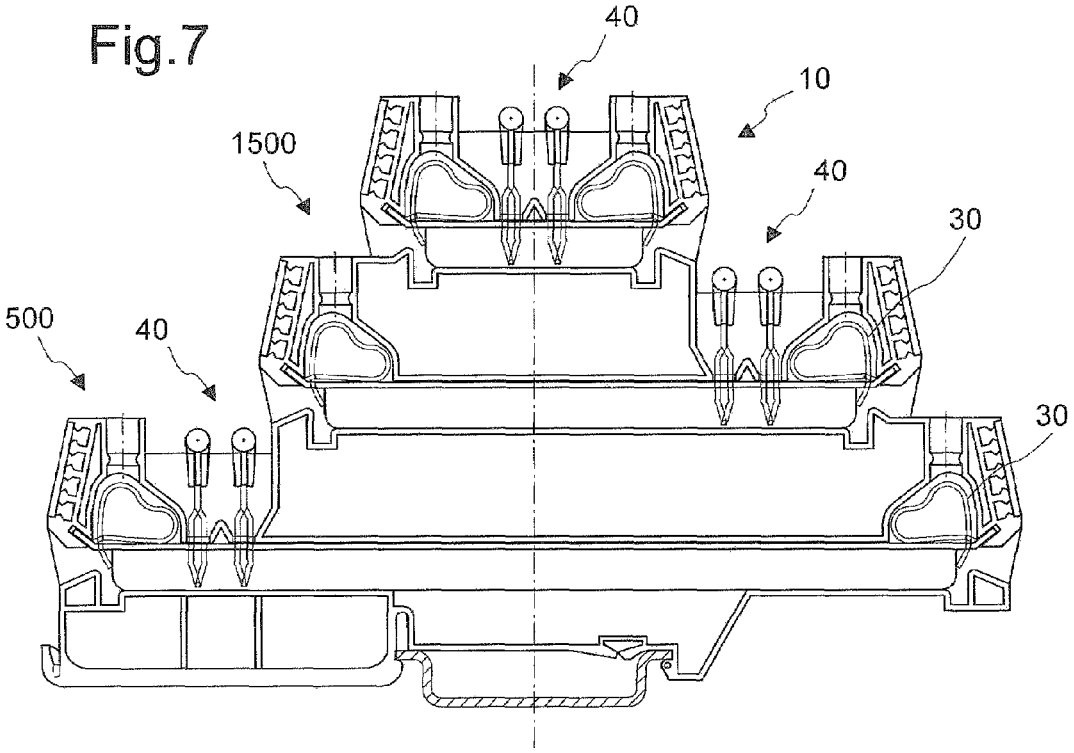
FIG. 7 shows a schematic cross-section, along a vertical longitudinal plane, of a fourth embodiment of the terminal block according to the invention.
Figure 8:
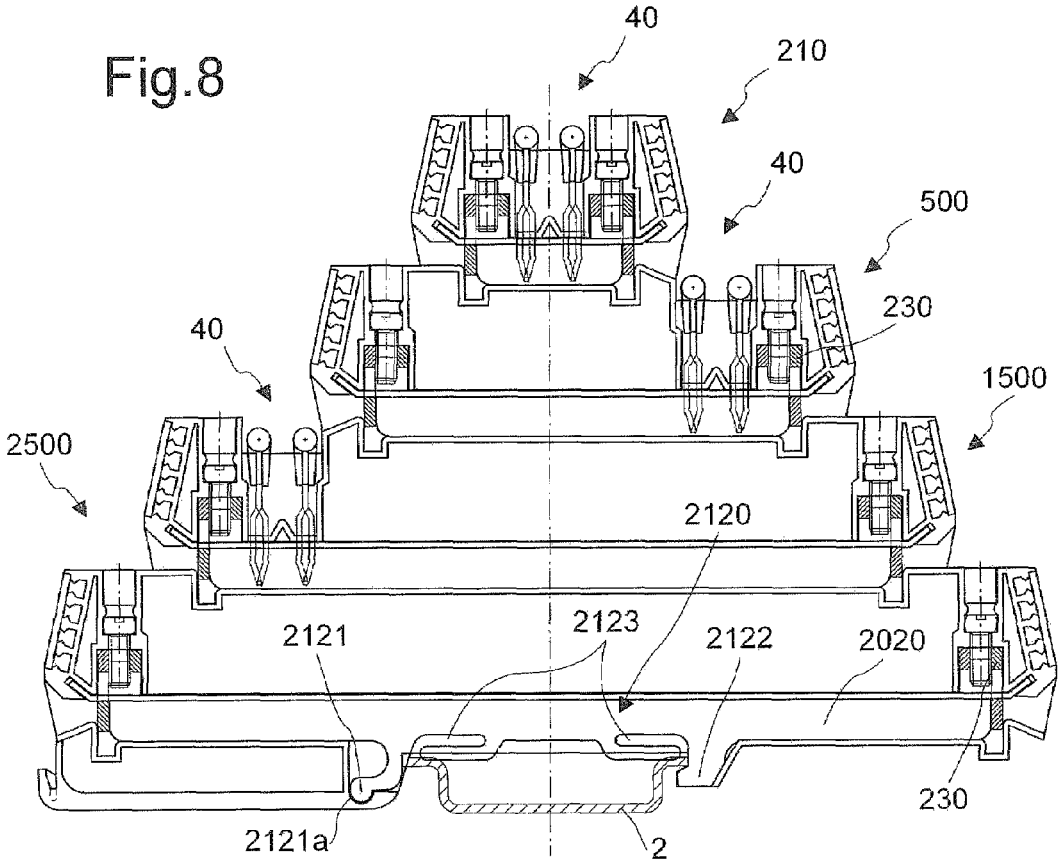
FIG. 8 shows a schematic cross-section, along a vertical longitudinal plane, of a fifth embodiment of the terminal block according to the invention.

FIGS. 7 and 8 show two further embodiments of the terminal block according to the invention which are designed with a multiple form extending in the direction Z-Z.

In greater detail, the terminal block has a first terminal 10,110,210 joined to at least a first base 500,1500,2500 having a longitudinal dimension X-X greater than that of the end terminal and/or the upper base which is immediately adjacent.

As shown, said base 500,1500,2500 may be designed with a symmetrical form 2500 relative to the axis Z-Z or asymmetrical form relative to the latter. In the case of an asymmetrical form, it may be right-hand 500 or left-hand 1500 depending on the orientational layouts shown in the figures, so that all the terminals 40 with the same polarity are aligned in a single row parallel to the transverse axis Y-Y and all the terminals with opposite polarity are aligned in another row parallel to the said transverse direction Y-Y and arranged in a different plane.

FIG. 8 also shows an embodiment of the conducting part 2020 which has engaging means 2120 for grounding by means of the rail 2 supporting the terminal block; these grounding means comprise first engaging parts 2121 for engagement with a corresponding seat 2121*a* of the insulating body of the terminal block, second engaging parts 2122 for engagement with the bottom surface of the rail 2, and resilient means 2123 extending in the longitudinal direction and symmetrically with respect to the axis Z-Z, for engagement with the upper part of the rail 2.

Engagement with the rail is performed by means of resilient deformation of the said means 2123, while release is performed by means of resilient deformation of the seat 2121*a* of the insulating body.

Preferably said engaging means 2120 for performing grounding are formed as one piece with the conductor 2020 and on both its sides 21*b* so as to improve the stability of the terminal block when engaged with the rail 2.

As shown, but not described in detail, in this case also the wire gripping parts may be of the type comprising spring 30, screw clamp 130, screw clamp in the form of an "overturned L" 230, as described above, or combinations thereof, as shown in FIG. 6.

It is therefore clear how, with the terminal block according to the invention, it is possible, owing to the particular U-shaped form of the conducting part, to design the latter with a large conducting cross-section which allows the use of materials which do not have a high conductivity and therefore are much more economical, without affecting the size of the terminal block which may be kept sufficiently small in relation to the electric loads envisaged.

On the other hand, should a much greater electric load be required, it will be possible to adapt the terminal block, using materials with a high conductivity, which do not require a corresponding increase in the cross-sections and therefore the overall dimensions of the terminal block, this basically allowing greater standardization of the insulating body in relation to different conducting parts required, with consequent lower costs in terms of production and warehouse management where a smaller number of codes is required.

In addition to this, with the terminal block according to the invention, it is possible to keep unchanged operation of the cable insertion and gripping parts which are always the same in all the versions, independently of the type of wire retaining part (spring or screw).

What is claimed is:

1. A terminal block for connecting electric wires comprising:

an insulating body;

a conducting part housed inside the insulating body;

a retaining part for retaining an end of an electric wire extending in a longitudinal direction, wherein the conducting part includes:

a U-shaped body having a base extending in the longitudinal direction, parallel sides extending along the base in the longitudinal direction and from the base in a vertical direction, and flanges extending along the longitudinal direction at each end of the base of the U-shaped body, wherein the flanges form a surface to clamp the end of the electric wire using the retaining part, and wherein the retaining part includes a retaining element configured to pull a clamping element that is configured to clamp the electric wire against the surface of the flanges.

2. A terminal block according to claim 1, wherein the insulating body includes at least one lateral flank and the lateral flank includes an opening that is adapted to receive a wire.

3. A terminal block according to claim 1, wherein the insulating body includes at least one hole in a substantially longitudinal end wall of the insulating body and the at least one hole is adapted to align with a hole in the conducting part and the holes are adapted to receive electrical connection jumpers.

4. A terminal block according to claim 1, wherein the retaining part for retaining the end of an electric wire includes a spring having a closed annular shape; and a side having an opening, a portion of the spring passing through opening and configured to engage on the conducting part.

5. A terminal block according to claim 1, wherein the insulating body has a closed annular structure defining a seat for housing the conducting part and the annular structure is open in a transverse direction.

6. A terminal block according to claim 5, wherein the closed annular structure is formed of two partial octagons which are situated facing each other relative to a vertical axis and each partial octagon including at least one front end side and at least one lateral flank.

7. A terminal block according to claim 6, wherein at least one front end side includes an opening in the vertical direction to allow access to the seat and to allow the introduction of an operating tool.

8. A terminal block according to claim 1, wherein the flanges include at least one having an inclined tip.

9. A terminal block according to claim 8, wherein at least one inclined tip is configured to engage a corresponding seat formed in an inner surface of insulating body.

10. A terminal block according to claim 8, wherein the base of the U-shaped body forms at least two holes and each hole is aligned coaxially with corresponding holes formed in the insulating body and adapted for receiving an electrical connection jumper.

11. A terminal block according to claim 8, wherein the retaining part for retaining the end of the electric wire is configured to be coupled to the flanges of the conducting part.

12. A terminal block according to claim 1, wherein the conducting part further includes engaging elements for grounding the conducting part to a rail supporting the terminal block.

13. A terminal block according to claim 12, wherein the engaging elements include first engaging parts for engagement with a corresponding seat of the insulating body of the terminal block, second engaging parts for engagement with a bottom surface of the rail and resilient elements extending in the longitudinal direction and symmetrically with respect to the vertical axis, for engagement with a top part of the rail.

14. A terminal block according to claim 12, wherein the engaging elements for grounding are formed from the conducting part and extend from both sides thereof.

15. A terminal block according to claim 1, wherein the retaining part for retaining an electric wire includes a screw.

16. A terminal block according to claim 15, wherein a front end portion of the insulating body forms a housing for the screw and includes a hole providing access to a head of the screw.

17. A terminal block according to claim 15, wherein the retaining part includes a body portion in the form of an overturned L having a vertical side extending a vertical length and horizontal side extending a horizontal length, wherein the vertical length is greater than the horizontal length.

18. A terminal block according to claim 17, wherein the horizontal side has a free end folded downwards in a substantially vertical direction.

19. A terminal block according to claim 18, wherein the folded free end is adapted to interfere with the operating device to ensuring locking thereof once tightened.

20. A terminal block according to claim 17,wherein the vertical side is arranged perpendicularly with respect to a longitudinal direction of insertion of a wire.

21. A terminal block according to claim 17, wherein the vertical side includes an opening adapted to allow insertion of the end of a wire.

22. A terminal block according to claim 17, wherein the horizontal side includes an engagement part for engagement with an operating device of the retaining part.

23. A terminal block according to claim 22, wherein the engagement part includes a hole extending along a vertical axis having a female thread and the operating device includes a screw shank having a thread corresponding to the female thread.

24. A terminal block according to claim 1, further comprising:

a second insulating body coupled to the insulating body and a second conducting part housed inside the second insulating body, and a second retaining part for retaining an end of a second electric wire wherein the second conducting part has a U-shaped body.

25. A terminal block according to claim 24, wherein the retaining part includes a spring, a screw clamp and a screw clamp in a form of an overturned L.

26. A terminal block according to claim 24, wherein the second insulating body has a larger longitudinal dimension than that of the insulating body.

27. A terminal block according to claim 26, wherein at least one insulating body is symmetrical with respect to a central vertical axis.

28. A terminal block according to claim 26, wherein at least one insulating body is asymmetrical with respect to a central vertical axis.

29. A terminal block according to claim 28, wherein the asymmetrical insulating body has a right-hand design.

30. A terminal block according to claim 28, wherein the asymmetrical insulating body has a left-hand design.

31. A terminal block according to claim 28, wherein all the terminals corresponding to a first polarity of electricity are aligned in a single row parallel to a transverse axis and all the terminals corresponding to a second polarity are aligned in another row parallel to the same transverse axis and arranged in a different plane.

* * * * *